US007673577B2

(12) United States Patent
Poldervaart et al.

(10) Patent No.: US 7,673,577 B2
(45) Date of Patent: Mar. 9, 2010

(54) ENHANCED SIDE-BY-SIDE MOORING CONSTRUCTION

(75) Inventors: Leendert Poldervaart, Monaco (MC); Hein Oomen, Nice (FR); Hein Wille, Eze (FR)

(73) Assignee: Single Buoy Moorings Inc., Marly (CH)

( * ) Notice: Subject to any disclaimer, the term of this patent is extended or adjusted under 35 U.S.C. 154(b) by 207 days.

(21) Appl. No.: 11/887,008

(22) PCT Filed: Mar. 20, 2006

(86) PCT No.: PCT/NL2006/050058

§ 371 (c)(1),
(2), (4) Date: Sep. 24, 2007

(87) PCT Pub. No.: WO2006/101395

PCT Pub. Date: Sep. 28, 2006

(65) Prior Publication Data

US 2009/0078185 A1 Mar. 26, 2009

(30) Foreign Application Priority Data

Mar. 22, 2005 (EP) ..... 05102291

(51) Int. Cl.
*B63B 21/00* (2006.01)

(52) U.S. Cl. ..... 114/230.1; 114/230.2

(58) Field of Classification Search ..... 114/230.1, 114/230.2; 414/141.3, 142
See application file for complete search history.

(56) References Cited

U.S. PATENT DOCUMENTS

| | | | | |
|---|---|---|---|---|
| 3,950,805 | A | 4/1976 | Murphy et al. | |
| 4,119,051 | A | 10/1978 | Orndorff, Jr. et al. | |
| 4,281,611 | A * | 8/1981 | Vilain | 114/230.14 |
| 4,459,077 | A * | 7/1984 | Franke | 414/140.9 |
| 5,501,625 | A | 3/1996 | Belinsky et al. | |
| 2003/0061980 | A1 | 4/2003 | Cottrell et al. | |

FOREIGN PATENT DOCUMENTS

| | | |
|---|---|---|
| EP | 1 413 511 A1 | 4/2004 |
| FR | 2 804 081 A | 7/2001 |
| FR | 2 824 528 A | 11/2002 |

* cited by examiner

*Primary Examiner*—Stephen Avila
(74) *Attorney, Agent, or Firm*—Young & Thompson

(57) ABSTRACT

The invention relates to a floating offshore structure anchored to the sea bed. The floating offshore structure comprises a hull having longitudinal sides and transverse sides, bow and stern anchoring points for mooring a tanker vessel alongside the offshore structure, a deck at a predetermined height above sea level, hydrocarbon storage and/or processing devices being placed on the deck, a spacer member attached to the structure and projecting transversely from the sides for contacting a tanker vessel moored alongside the structure. The anchoring points of the structure comprise of quick release members, wherein the bow and/or stern anchoring points of the structure are situated on a deck which projects transversely from the hull of the structure substantially at the heights of anchoring points of the tanker vessel.

20 Claims, 6 Drawing Sheets

ENHANCED SIDE-BY-SIDE MOORING CONSTRUCTION

The invention relates to a floating offshore structure anchored to the sea bed, comprising longitudinal sides and transverse sides, bow and stern anchoring points for mooring a tanker vessel alongside the offshore structure, a deck at a predetermined hight above sea level, hydrocarbon storage and/or processing devices being placed on the deck, a spacer member attached to the structure and projecting transversely from the sides for contacting a tanker vessel moored alongside the structure.

It is known to moor two LNG carriers in a side-by-side configuration. Anchor lines extend between the carriers and tension the carriers against spacer members in the form of fenders that are situated between the two vessels. In the known mooring configurations, the carriers are of substantially similar size and are attached with mooring lines of a length of less than 10 m, such as 8 m. The offshore side-by-side mooring configuration responds to environmental conditions as a single vessel. Under mild offshore conditions, the side-by-side mooring configuration can be applied to moor a carrier to a larger structure such as a floating storage and regasification unit (FSRU). This standard side-by-side mooring and fluid transfer configuration is possible in sea states up to 1.5 m significant waves, wherein the vessels need to be disconnected in sea states higher than 2 m. These conditions often prevail, especially in harsher environments, such that the effective operational availability of the known systems is limited.

It therefore is an object of the present invention to provide a side-by side mooring and fluid transfer configuration, especially for hydrocarbon vessels such as oil, or LNG, which provides also a reliable mooring and fluid transfer at relatively high sea states, such as 2 m or higher.

It is another object of the present invention to provide a side-by-side mooring and fluid transfer configuration which has an improved dynamic response.

It is a further object of the present invention to provide a mooring and fluid transfer configuration in which vessels of different size can be effectively moored to the offshore structure and can be loaded or offloaded from a position between bow and stern of the vessel.

Hereto the offshore structure according to the present invention is characterised in that the anchoring points of the structure comprise of quick release members, wherein the bow and/or stem anchoring points of the structure are situated on a deck, which projects transversely from the hull of the structure substantially at the heights of anchoring points of the tanker vessel.

By situating the anchoring points on the structure on outboard decks, they take up relatively little deck space. Furthermore, the relatively narrow outboard decks result in little contact of the anchor lines, such that the end parts, attached to the quick release members, can be made of synthetic rope material without the danger that the rope material rubs, wears or is damaged otherwise by the deck when the quick release hook is opened.

The offshore structure, preferably a FSRU which is anchored to the sea bed via mooring lines, is moored to a single offshore position for longer periods of time. These structures can be a tanker which is converted into a FSRU or a newly built structure which has very large dimensions, such as a length of 220 m-400 m, a width of 30-80 m and have a deck at a level which is situated above the maximum significant wave height, such as at a height of between 10 and 30 m above sea level. The distance between the offshore structure and the moored vessel can be in the range of 4 to 30 m.

Vessels moored to the structure, such as LNG carriers, often have deck levels which are situated closer to sea level, such as 10 m above sea level, especially if the FSRU is a newly built construction. By providing the anchoring points on such a newly built offshore structure at lowered positions, the anchor lines that extend between deck level of the moored carrier and the offshore structure can be situated in a substantially horizontal plane, having an angle of not more than 30° with the horizontal. By placing the anchor lines in a substantially horizontal configuration, the anchor lines allow a (limited) freedom of roll, pitch and sway motions of the structure and the moored tanker vessel without the danger of forces in the mooring lines becoming excessively large. As the mooring lines are more or less horizontal, the mooring stiffness is maximal as the pulling forces in the mooring lines between the structure and the vessel are working directly against each other in one plane.

The possibility of relative motions of the structure and the tanker vessel or moored to the structure allows the structure and the carrier to remain connected and operational in fluid transfer at higher sea states, such as 3 m significant wave heights. The horizontal configuration of the anchor lines is especially useful for the breasting lines, which extend substantially transversely to the length direction and which are of relatively short length (generally shorter than 25 m). For the spring anchor lines, which extend generally in the length direction of the vessel and which can be of length of over 30 m, such as for instance 50 m or more, the substantially horizontal configuration is less important as lines of these length will have a greater extendability and have a more gradual change of height over their length results in a more favourable distribution of forces.

The offshore structure is preferably formed by a floating FSRU which can be a converted tanker or a newly built barge which have a rectangular barge-shape with a draft level of 8-13 m and a hydrocarbon storage volume of 120.000-400.000 $m^3$. LNG processing facilities such as a liquefaction or regasification plants, separators, pumps, vaporisers, power generators etc may be situated on the deck. The mooring configuration can be a spread mooring or can comprise a weathervaning mooring structure in which the barge is anchored via a turret system or is moored to a single point mooring buoy or tower in a weathervaning manner.

The mooring points on the structure may be placed on decks which project transversely from the hull or can be situated on lowered decks which are situated within the perimeter of the structure.

For accommodating tanker vessels of different lengths, the offshore structure comprises, in one embodiment, a first set of at least two anchoring points on one side of the midship position, a second set of at least two anchoring points at a first distance from the first set of anchoring points, and a third set of at least two anchoring points at a second distance from the first set of anchoring points, wherein the second distance is larger than the first distance. In this manner tanker vessels such as LNG carriers of different capacities (100.000 $m^3$-200.000 $m^3$) can be moored in a similar manner. Winches, normal or constant tension winches, are available on standard LNG carrier vessels and can be utilised for paying out the mooring lines such that they can be picked-up by a tug boat and brought over to the floating structure and can be utilised for pulling in the mooring lines.

For accommodating the relative movements of the structure and the tanker vessel, the spacer member or fender may be connected in a pivotable manner to the structure, to allow vertical and horizontal displacement of the spacer member.

In order to allow sideways relative motions of the tanker vessel and the offshore construction, the transfer arm for transfer of hydrocarbons from or to the tanker vessel, is telescopically extendible by a length of at least 4 m. It is also possible to place the transfer arm on the spacer member between the vessel and the structure. Suitable transfer arms are described in patent publications FR 2854156, WO 02/092422, WO 02/28765 and unpublished patent application EP 04076313.8 in name of applicant.

In order to compensate for varying mooring positions of the tanker vessel along the offshore construction in the length direction caused by movements during mooring, or caused by tanker vessels of different dimensions, the loading/offloading arm on the offshore construction can be displaceable in the length direction. The loading/offloading arm can be supported in a pivoting manner, but can also be placed on a displaceable frame which can be moved on a track on deck of the offshore construction.

In one embodiment, the mooring lines attaching the tanker vessel to the offshore construction are comprised of a first section, attached to the tanker, of steel, and a second section of synthetic rope material, the anchor lines extending at an angle to a transverse direction, the length of the synthetic rope material section being longer than 10 m, preferably longer than 20 m, most preferably longer than 25 m. By the relatively long synthetic sections, an increased amount of elasticity is imparted to the mooring configuration, allowing relatively large movements of the tanker vessel relative to the offshore construction. A favourable mooring configuration is formed by at least 4 groups of mooring lines, of two or more parallel lines each. The mooring lines are attached to the offshore construction via quick release hooks.

Some embodiments of an offshore structure and moored tanker vessel according to the present invention will be explained in detail with reference to the accompanying drawings. In the drawings.

Figure 1:
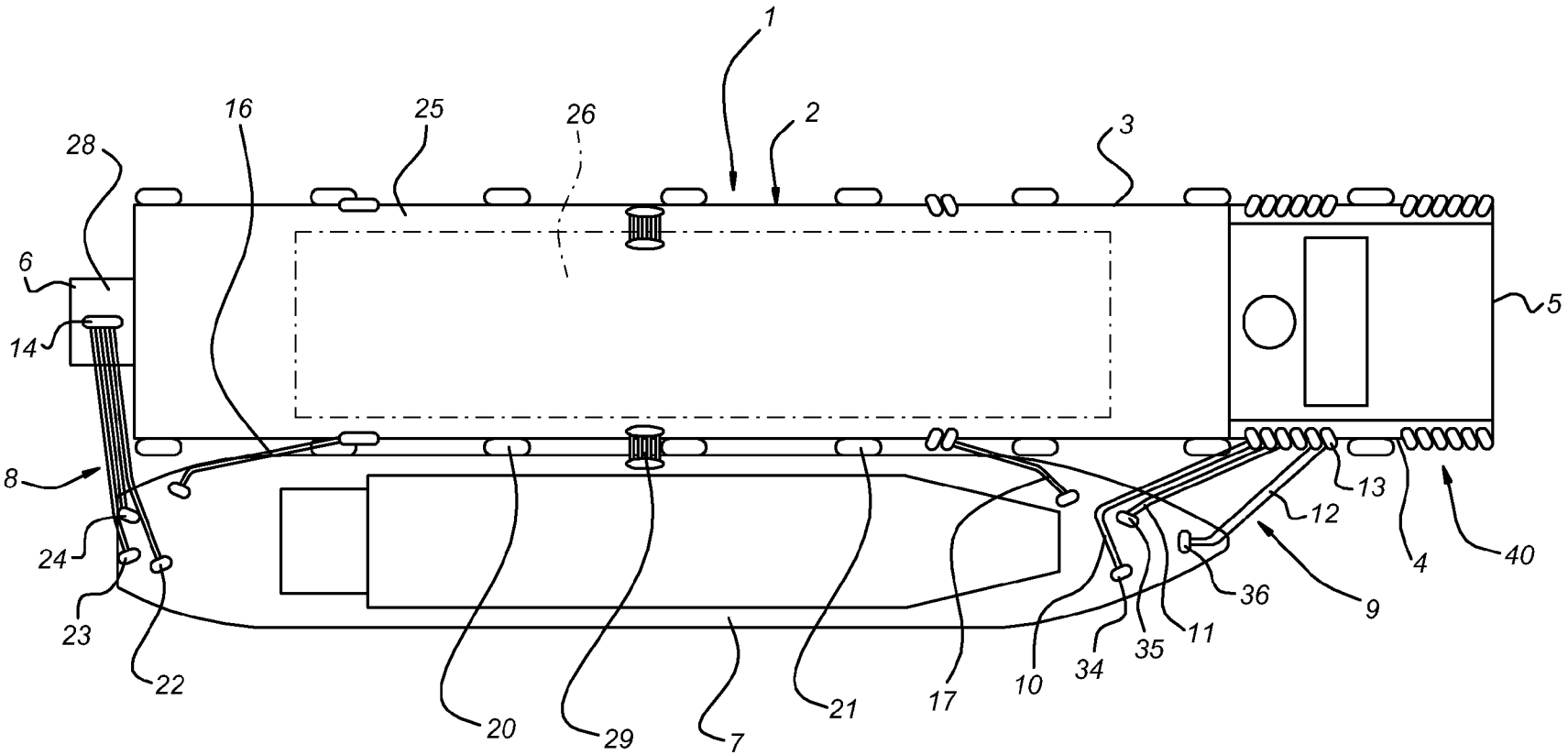
FIG. 1 shows a top view of a mooring assembly according to the present invention.

FIG. 1 shows an offshore structure 1, such as a newly built FSRU or a weathervaning newly built FPSO (floating production storage and offloading). The structure 1 comprises a hull 2 with longitudinal sides 3, 4 and transverse sides 5, 6 at bow and stem. A tanker vessel 7 is moored alongside the structure 1 via groups of mooring lines 8, 9 at stem and bow. The bow mooring lines 9 (breasting lines) comprise three groups 10, 11, 12 of two parallel mooring lines each, which are attached to six bow anchoring points 13 on the structure 1. The rear mooring lines 8 (breasting lines) also comprise three groups of two parallel lines each, attached to stern anchoring points 14 on the structure 1. Spring mooring lines 16, 17 extend from a rearward and forward position on the vessel 7 respectively, towards a near midship anchoring point on the structure 1. A number of resilient fenders 20, 21 are situated between the tanker 7 and the structure 1, the tanker being pulled against the fenders 20, 21 by the groups of mooring lines 8, 9, 16 and 17. A transfer duct 29, such as one or more flexible hoses, pivoting hard pipes or combinations of hard pipe with flexible hoses, extends between the tanker vessel 7 and hydrocarbon storage tanks 26 on the structure 1 for loading and offloading hydrocarbons, preferably LNG, between the tanker vessel 7 and the structure 1. The transfer duct 29 can be supported from a transfer arm 31 which can be displaced in the length direction of the structure 1.

Figure 2:
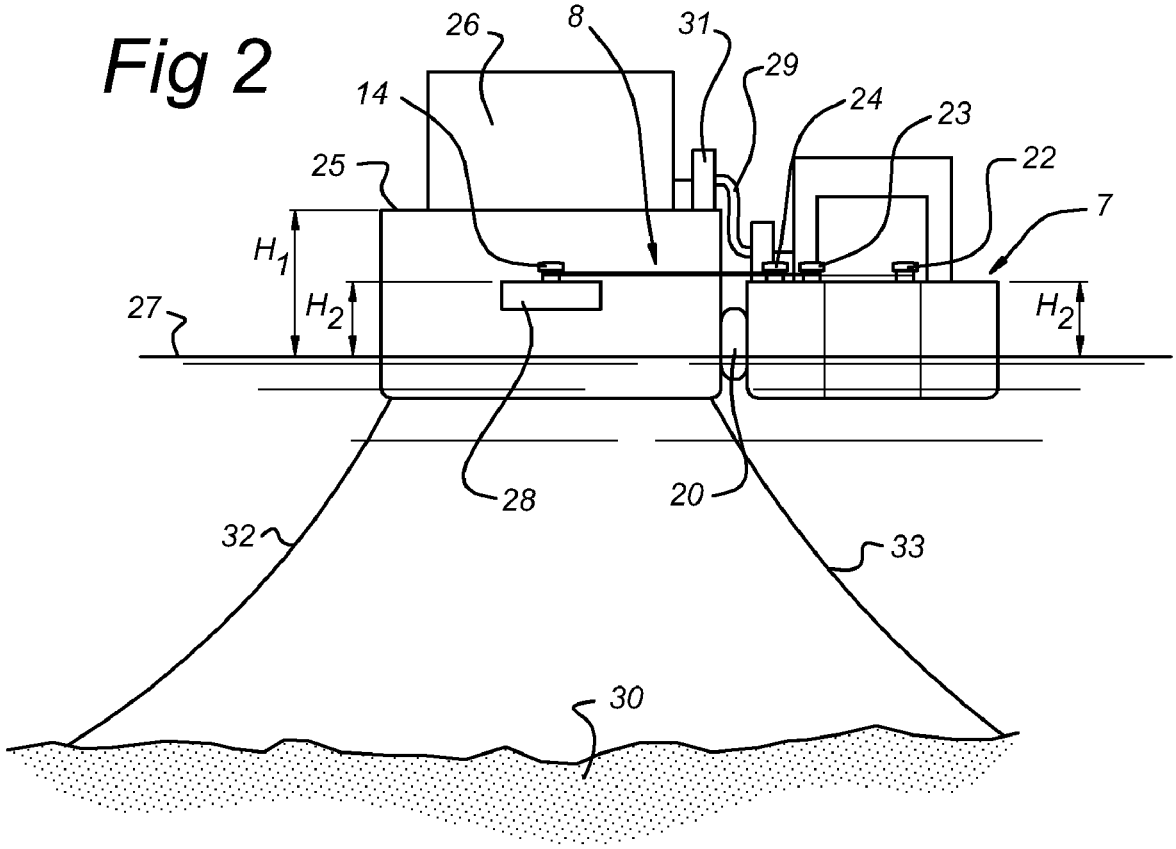
FIGS. 2 and 3 show a near view and a frontal view of the assembly of FIG. 1.

As can be seen from FIG. 2, the mooring line attachment points 22, 23 and 24 on the tanker vessel 7 are situated at the same height as the stem anchoring points 14 on the structure 1, such that the anchor line groups 8 extend in a substantially horizontal plane. The structure 1 comprises a deck 25 and hydrocarbon processing and/or storage facilities 26 placed on or partly integrated within the deck 25. The deck 25 is situated at a distance H1 above sea level 27, for instance 20-30 m. The anchoring points 14 are situated on a deck 28 at the stem, which is situated nearer to sea level at a height H2, which may be in the range of 10-20 m, and which corresponds to the height H2 above sea level 27 of the mooring line attachment points 22, 23, 24 on the tanker vessel 7.

The structure 1 is moored to the sea bed 30 via anchor legs 32, 33 in a spread moored configuration. Alternatively, it is possible that the structure 1 is provided with a rotary turret in its hull 2 and is anchored via the turret to the sea bed in a weathervaning manner, or is anchored at its bow to a single point mooring buoy or to a seabed supported tower.

Figure 3:
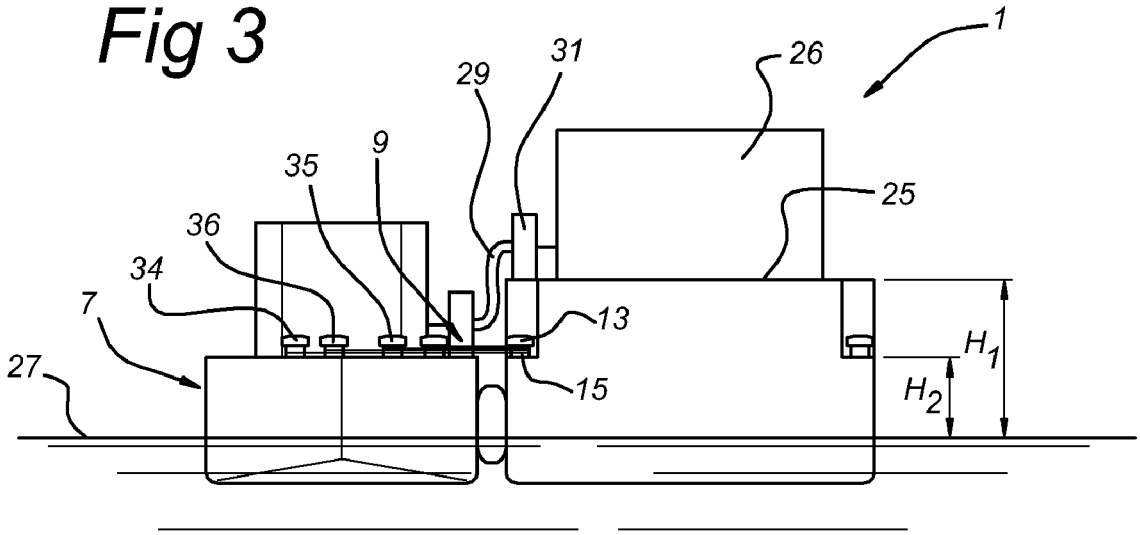

In FIG. 3 a bow view of the structure 1 and the tanker vessel 7 of FIG. 1 is shown. The bow anchoring points 13 on the structure 1 are situated at a lower deck 15 which is situated below the main deck 25 of the structure. The bow anchoring points 34, 35, 36 of the vessel 7 are situated at the same height H2 above sea level as the deck 15.

Figure 4:
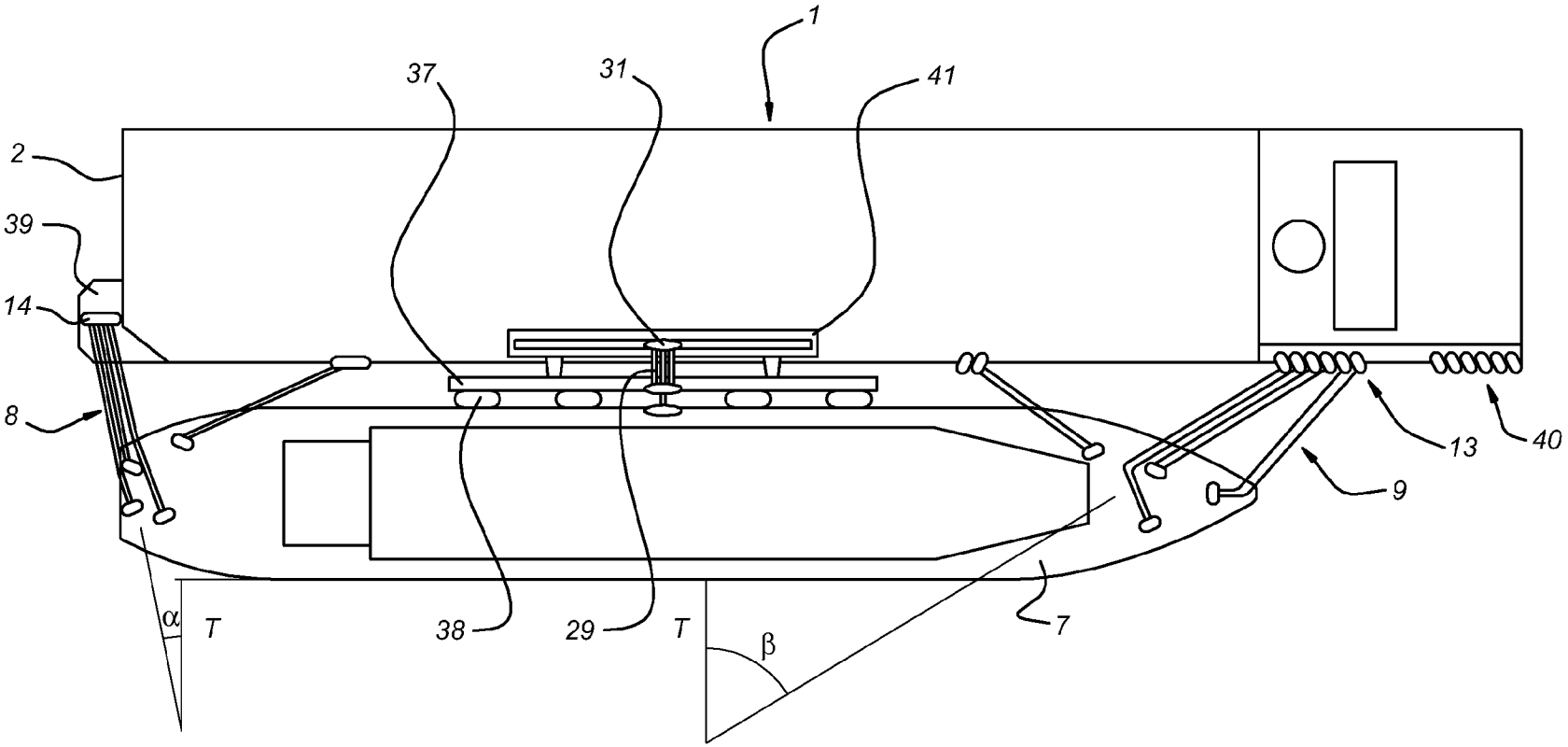
FIGS. 4 and 5 show a mooring configuration for carriers of different length.
Figure 5:
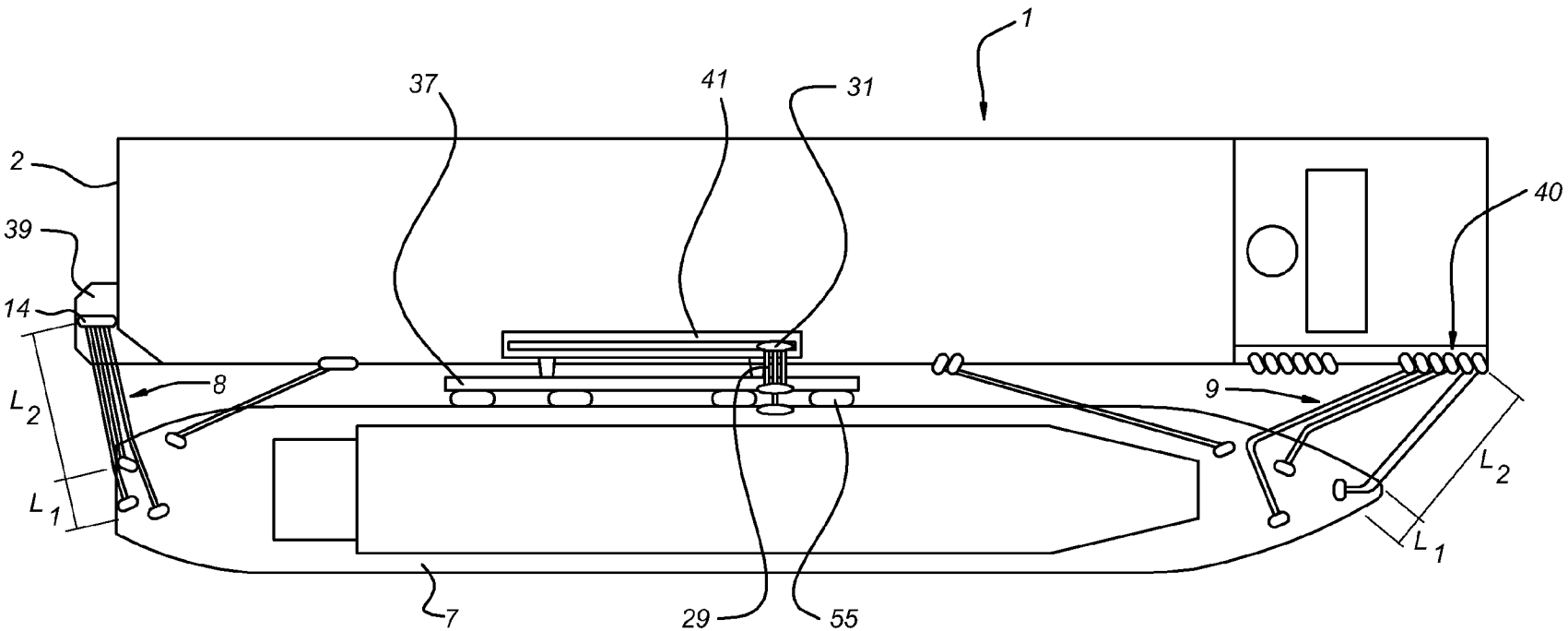

FIG. 4 shows a tanker vessel 7 of a first length moored to the structure 1 via sets of mooring points 13, 14 on the bow and stern of the structure 1. The transfer duct 29 is supported by an arm 31 which can be movable along a track 41 which extends in the length direction of the structure 1, in order to align the duct 29 with the mid-ship manifold of the tanker vessel 7. The spacer member comprises a frame 37 and a number of resilient members, such as inflated bumper elements or fenders, 38 supported on the frame 37. The rear mooring points 14 are situated on a deck 39, projecting transversely outboard from the hull 2 of the structure 1. The stern mooring lines 8 are generally at an angle $\alpha$ of between 0 and 45° to the transverse direction T. The bow mooring lines 9 extend at an angle $\beta$ which in some cases can be more than 45°. It can be seen that a third set of anchoring points 40 is situated near the bow of structure 1 but is not occupied by any mooring lines. In FIG. 5 a large tanker vessel 7 is moored to the structure 1, wherein the stern anhoring points 14 and the frontmost bow anchoring points 40 are occupied. The arm 31 supporting the transfer duct 29 has been moved along the tracks 41 to be aligned with the midship transfer manifold of tanker vessel 7 in FIG. 5. In an alternative configuration (not shown) the transfers ducts can be supported by the frame 37.

The mooring lines 8, 9 have a first section LI of steel cable, for instance of a diameter of about 50 mm and in a moored configuration of a length of 10-30 m. The steel cable can have a length up-to 220 m so it can function as a pick-up line as well during the berthing operation. But in a moored side-by-side configuration most of steel cable will be on the winch. The steel cable is guided via a fairlead on the tanker vessel 7 towards the FSRU. The part which is above the deck on the tanker vessel 7 (from winch to fairlead) must always be a steel cable part as synthetic rope will wear or be damaged at the deck or at the fairlead. Attached to the steel cable section is a synthetic rope section L2 for instance of Nylon of a diameter of about 90 mm and a length of 10-35 m. The steel cable parts L1 provide an abrasion resistant part near the vessel 7, whereas the relatively long synthetic mooring line parts L2 provide a resilient mooring configuration.

Figure 6:
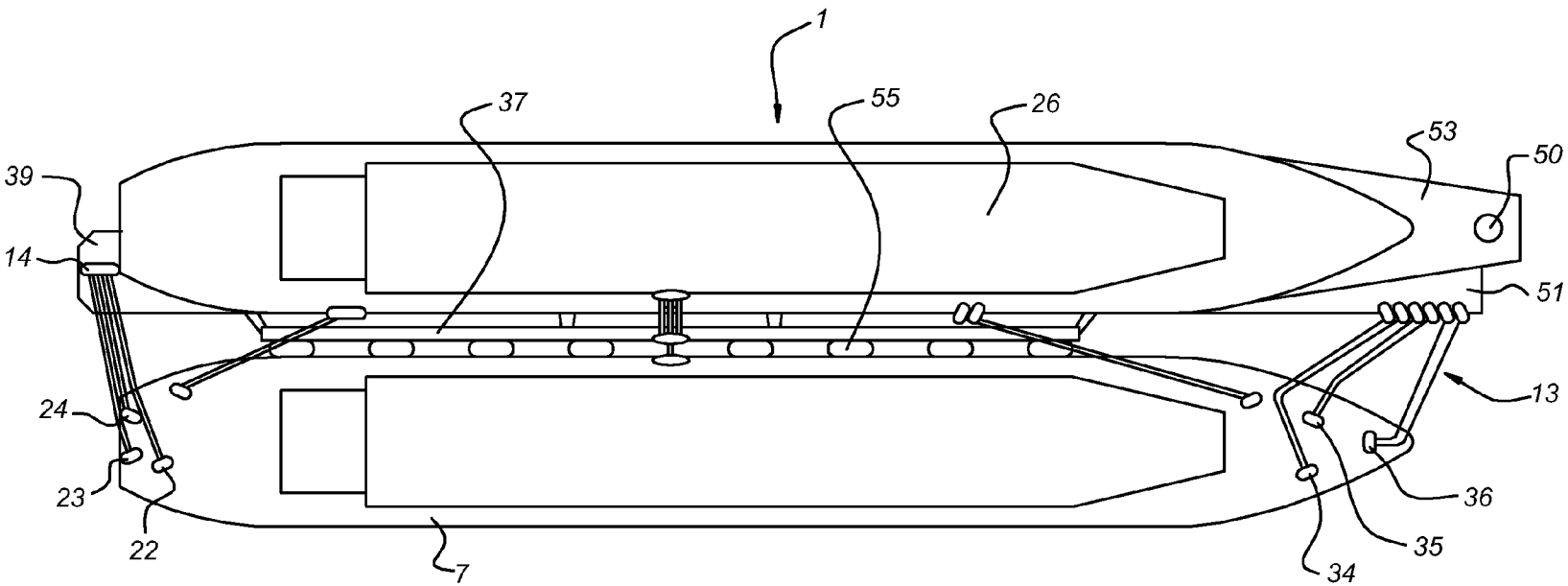
FIGS. 6 and 7 show a top view and a frontal view, respectively, of an embodiment of a mooring assembly wherein the floating structure is formed by a converted tanker and comprises outboard decks.
Figure 7:
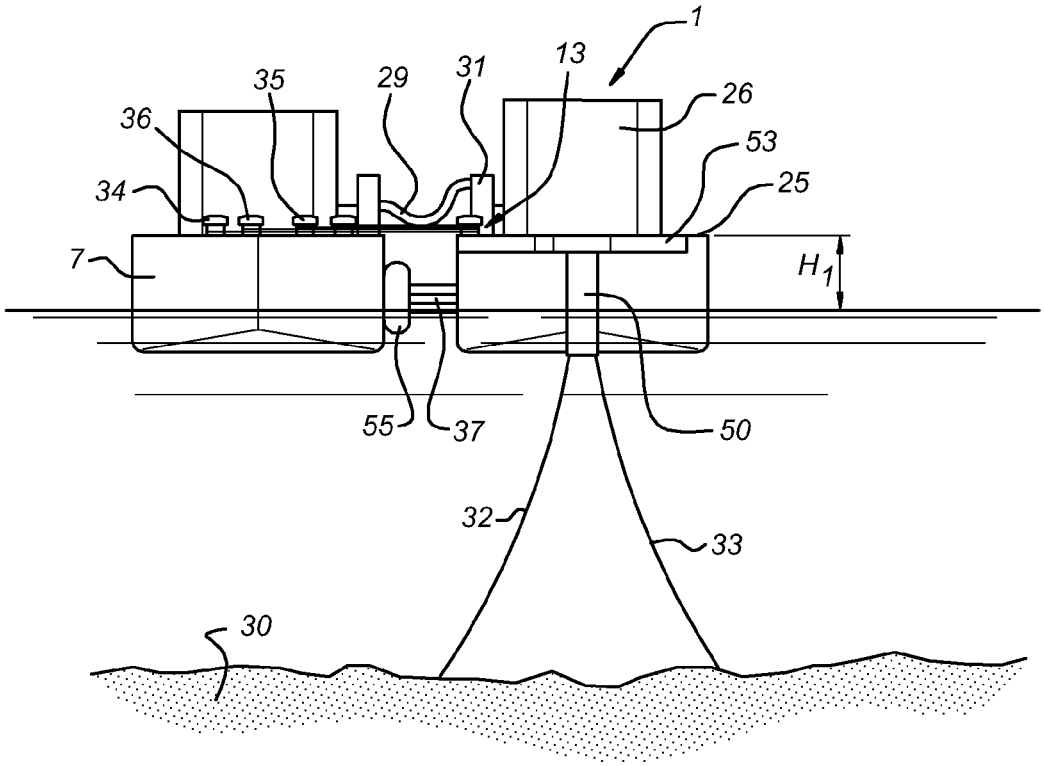

FIGS. 6 and 7 shows a tanker vessel 7 being moored to the structure 1, which is formed by a FSRU based on a converted tanker. The FSRU 1 has similar dimensions as the tanker vessel 7 with a length of between 200 m and 300 m, a width of 35 m-50 m and a draft between 8 m and 13 m. The FSRU 1 is anchored to the sea bed 30 via an external turret 50 and anchor lines 33, 32, in a weathervaning manner. The deck 25 of the FSRU is situated at a distance above sea level, similar to deck level of the tanker vessel 7, such that the anchoring points 13, 14 on the FSRU are at substantially the same height as the corresponding anchoring points 22, 23, 24 and 34, 35, 36 on stem and bow of the tanker vessel 7.

The anchoring points 13, 14 on the FSRU 1 are situated on outboard decks 39, 51 that are attached to the hull 2 and that extend sideways from the hull. On the decks 39, 51 quick release hooks are placed of the type shown in FIG. 8. By the small width of the outboard decks 39, 51, the anchor line parts attached to the FSRU 1 do not need to extend over the main deck 25 of the FSRU 1. Hence the anchor lines do not occupy available deck space. The use of the relatively narrow outboard decks 39, 51 results in reduced possibilities of contact between the anchor line part at the side of the FSRU and hence in reduced wear. The anchor line sections extending over the outboard decks 39, 51 can be comprised of synthetic rope material, such as nylon ropes which have increased flexibility compared to steel cables.

In the embodiment of FIGS. 6 and 7, the FSRU is about equal in length as the tanker vessel 7. The FSRU can be extended in length, for instance by elongation of the hull 2 by addition of a hull part, for instance for accommodating an on board power generating plant.

Figure 8:
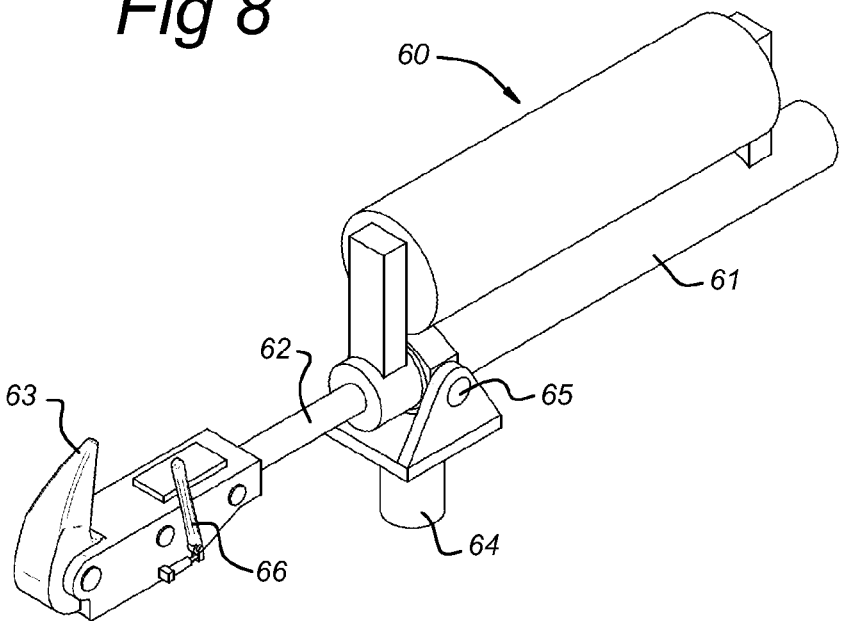
FIG. 8 shows a three dimensional view of a quick release hook.

In FIG. 8 a quick release coupling 60 is shown comprising a hydraulic cylinder 61 and an extendable arm 62. A pivotable hook 63 serves as a catch for a mooring eye on the end of a mooring line. In combination with the quick release coupling 60, a relatively short nylon rope can be used, in view of the extendable shock absorber, or arm 62. The coupling 60 can be rotated around a vertical axis 64 and a horizontal axis 65. The coupling has a locking mechanism 66 for locking the loop of the mooring line and for preventing motion of the mooring line and loop over the top of the hook 63.

The invention claimed is:

1. Floating offshore structure (1) anchored to the sea bed (30), comprising a hull (2) having longitudinal sides (3, 4) and transverse sides (5, 6), bow and stern anchoring points (13, 14, 40) for mooring a tanker vessel (7) alongside the offshore structure, a deck (25) at a predetermined height (H1) above sea level (27), hydrocarbon storage and/or processing devices (26) being placed on the deck (25), a spacer member (20, 21) attached to the structure and projecting transversely from the sides for contacting a tanker vessel moored alongside the structure, characterised in that, the anchoring points (13, 14, 40) of the structure (1) comprise of quick release members (60), wherein the bow and/or stern anchoring points (13, 14, 40) of the structure (1) are situated on a deck (28, 39, 51) which projects transversely from the hull (2) of the structure (1) the height of the deck (28, 39,51) being such that anchor lines extending from said anchoring points (13, 14, 40) to the tanker vessel are at an angle of not more than 30° with the horizontal.

2. Floating offshore structure (1) according to claim 1, wherein the deck (28, 39, 51) is situated substantially at the heights of anchoring points (34, 35, 36) of the tanker vessel (7).

3. Floating offshore structure (1) according to claim 1, the structure (1) being anchored to the sea bed (30) via an outboard turret (50), the hull (2) comprising hydrocarbon storage tanks of a volume of between 100.000 $m^3$ and 500.000 $m^3$, having a length of at least 220 m, a width of at least 30 m and a height above sea level of at least 15 m.

4. Floating offshore structure (1) according to claim 1, wherein the bow and stern anchoring points (13, 14, 40) are positioned at an anchoring level (H2),which is situated at least 1 m below deck level (H1).

5. Floating offshore structure (1) according to claim 1, wherein the anchoring points (13, 14, 40) are placed on a deck (28, 39, 51) which extends along a longitudinal side (3, 4) and/or a transverse side (6) of the hull (2).

6. Floating offshore structure (1) according to claim 1 wherein the offshore structure comprises a first set (8) of at least two anchoring points on one side of the mid ship position, a second set (13) of at least two anchoring points at a first distance from the first set of anchoring points, and a third set (40) of at least two anchoring points at a second distance from the first set of anchoring points (8), wherein the second distance is larger than the first distance.

7. Floating offshore structure (1) according to claim 6, wherein both the second and third sets of anchoring points (13, 40) comprise a quick release member.

8. Floating offshore structure (1) according to claim 1, wherein the spacer member comprises a frame structure (37) and a resilient contact member (38) being attached to a frame structure, wherein the frame structure is connected to the hull (2) via a hinging connection allowing hinging of the frame structure in a vertical direction and in a length direction of the structure.

9. Floating offshore structure (1) according to claim 1, wherein a transfer duct (29) is provided, in fluid connection with a hydrocarbon storage tank (26), the transfer duct (29) being supported on a movable arm (31) which is displaceable in a length direction of the structure (1).

10. Floating offshore structure (1) of claim 1, wherein the processing devices comprise a hydrocarbon storage tank (26), and further characterised in that, a transfer duct (29) is provided, in fluid connection with the hydrocarbon storage tank (26), the transfer duct (29) being supported on a movable frame (31) which is displaceable along a track (41) in a length direction of the structure (1).

11. Floating offshore structure (1) according to claim 10, wherein the transfer duct (29) comprises a loading arm which is telescopically extendable in the transverse direction during loading/offloading by a distance of at least 4 m.

12. The floating offshore structure (1) of claim 1 in combination with a tanker vessel (7) moored alongside the offshore structure (1), characterised in that, the bow and stern anchor lines (13, 14) comprise a first section (L1), attached to the tanker (7), of steel, and a second section (L2) of synthetic rope material, the anchor lines extending at an angle ($\alpha$, $\beta$) to a transverse direction (T), the length of the synthetic rope material section (L2) being longer than 10 m.

13. Assembly according to claim 12, wherein the synthetic rope sections are connected to the structure (1) via a quick release member (60).

14. Assembly according to claim 13, wherein the spacer member (20, 21) has a length of between 4 and 10 m.

15. Assembly according to claim 12, wherein the anchor lines at the bow and at the stern each comprises at least 4 groups of at least two parallel lines.

16. Assembly according to claim 12, wherein the length of the offshore structure (1) is larger than 1.2 times the length of the tanker vessel (7).

17. Assembly according to claim 12, the tanker vessel (7) being moored to the structure (1) via a frame (37) extending along a length of the structure (1).

18. Assembly according to claim 12, wherein the anchor points (13, 14, 40) are situated substantially at a same height as a fluid transfer duct (29).

19. Assembly according to claim 12, wherein the quick release member (60) comprises an extendable arm (62), which is extendable when the force exerted the arm by a mooring line that is attached to said member (60).

20. Floating offshore structure (1) according to claim 2, the structure (1) being anchored to the sea bed (30) via an outboard turret (50), the hull (2) comprising hydrocarbon storage tanks of a volume of between 100.000 $m^3$ and 500.000 $m^3$, having a length of at least 220 m, a width of at least 30 m and a height above sea level of at least 15 m.

* * * * *